US007042160B2

(12) United States Patent
Hosea et al.

(10) Patent No.: US 7,042,160 B2
(45) Date of Patent: May 9, 2006

(54) PARALLEL PLATE ELECTRON MULTIPLIER WITH ION FEEDBACK SUPPRESSION

(75) Inventors: Kiki H. Hosea, Amherst, MA (US); Herman J. Boeglin, Meriden, CT (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 88 days.

(21) Appl. No.: 10/770,309

(22) Filed: Feb. 2, 2004

(65) Prior Publication Data

US 2005/0168155 A1 Aug. 4, 2005

(51) Int. Cl.
*H05B 31/26* (2006.01)
*H01J 43/00* (2006.01)

(52) U.S. Cl. ..... 315/111.81; 313/103 R

(58) Field of Classification Search ..... 315/111.81, 315/111.91; 313/103 R, 105 CM, 528
See application file for complete search history.

(56) References Cited

U.S. PATENT DOCUMENTS 4,095,132 A * 6/1978 Fraioli ..... 313/103 CM
4,757,229 A 7/1988 Schmidt et al. ..... 313/103 CM
4,978,885 A * 12/1990 White et al. ..... 313/103 CM
5,117,149 A 5/1992 Fijol ..... 313/103 R
5,374,864 A 12/1994 Roy et al. ..... 313/103 CM
5,440,115 A * 8/1995 Bauco et al. ..... 250/207
6,642,637 B1 * 11/2003 Spallas et al. ..... 313/103 R

OTHER PUBLICATIONS

Preparation and Characteristics of a Channel Electron Multiplier, H. Becker, E. Dietz, U. Gerhardt, The Review of Scientific Instruments, vol. 43, No. 11, Nov. 1972, pp. 1587-1589.
Channel Electron Multiplier Operation in the Continuous Current Mode, J. E. Rowe, S. B. Christman, R. D. Plummer, The Review of Scientific Instruments, vol. 42, No. 11, Nov. 1971, pp. 1733-1734.
A Computer Simulation Study on Electron Multiplication of Parallel-Plate Electron Multipliers, S. Suzuki, T. Konno, Rev. Sci. Instrum. 64(2), Feb. 1993, 1993 American Institute of Physics, pp. 436-445.

(Continued)

*Primary Examiner*—Trinh V. Dinh
*Assistant Examiner*—Minh Dieu A
(74) *Attorney, Agent, or Firm*—Cantor Colburn LLP

(57) ABSTRACT

An embodiment of the invention is an electron multiplier including a first plate having an electron emissive first interior surface. A second plate has an electron emissive second interior surface. A voltage source is connected across the first plate and the second plate. A collector generates a signal responsive to electron multiplication by the first plate and the second plate. The first interior surface and the second interior surface are parallel and are non-planar.

15 Claims, 7 Drawing Sheets

OTHER PUBLICATIONS

A computer Simulation Study on the Detection Efficiencies of Parallel-Plate Electron Multipliers, S. Suzuki, T. Konno, Rev. Sci. Instrum. 66(6), Jun. 1995, 1995 American Institute of Physics, pp. 3483-3487.

Parallell-Plate Electron Multipliers, P.A. Tove, S. Berg, L.P. Andersson, B. Ericsson, H. Norde, Teknikum, Uppsala University, Uppsala, Sweden, pp. 85-94.

A Parallel Plate Continuous Dynode Electron Multiplier with Carbon as Dynode Material, K. Feser, Seklion Physik der Universitat Munchen, Munchen, Germany, pp. 888-889.

C-A1 Parallel Plate Dynode Electron Multiplier, M. Kanayama, T. Konno, S. Kiyono, The Review of Scientific Instruments, vol. 40, No. 1, Jan. 1969, pp. 129-132.

Studies of a Parallel-Plate Electron Multiplier, B. Gelin, E Grusell, L. P. Andersson, S. Berg, J. Phys. E: Sci. Instrum., vol. 12, 1979.

Development of Parallel Plate Channel Multipliers for Use in Electron Spectroscopy, O. Nillson, L. Hasselgren, K. Siegbahn, S. Berg, L.P. Andersson, P.A. Tove, Clear Instruments and Methods 84 (1970) pp. 301-306.

* cited by examiner 500
502
504
FRONT 512
502
506
504
508
510
SIDE 502
504
ISOMETRIC

PARALLEL PLATE ELECTRON MULTIPLIER WITH ION FEEDBACK SUPPRESSION

BACKGROUND OF THE INVENTION

Electron multipliers are useful tools for various applications, including the detection of photons, electrons, ions and heavy particles. Such detectors are utilized in various spectroscopic techniques, including Auger electron spectroscopy (AES), x-ray photoelectron spectroscopy, ultraviolet photoelectron spectroscopy, and electron energy loss spectroscopy. Further, electron multipliers may be utilized for detection of secondary and back-scattered electrons in scanning electron microscopes, focused ion-beam tools, or e-beam lithography tools.

Typical electron multipliers are either channel type (e.g., multipliers that are tubular in nature) or flat plate type, including two flat plates that are usually parallel to each other. Channel electron multipliers can suppress ion feedback by shaping the channel (e.g., curved or spiraled) so that the travel distance of feedback ions is short. However, because of their geometry, channel electron multipliers are not suitable for the detection of incoming charged or energetic neutral particles or photon beams with a cross sectional profile that is not round. Parallel plate electron multipliers can be shaped to accommodate beam profiles that are not round. However, due to the fact that they are usually constructed with flat parallel plates they are prone to ion feedback problems.

There is a need in the art for a parallel plate electron multiplier that suppresses ion feedback.

BRIEF SUMMARY OF THE INVENTION

An embodiment of the invention is an electron multiplier including a first plate having an electron emissive first interior surface. A second plate has an electron emissive second interior surface. A voltage source is connected across the first plate and the second plate. A collector generates a signal responsive to electron multiplication by the first plate and the second plate. The first interior surface and the second interior surface are parallel and are non-planar.

DETAILED DESCRIPTION

Figure 1:
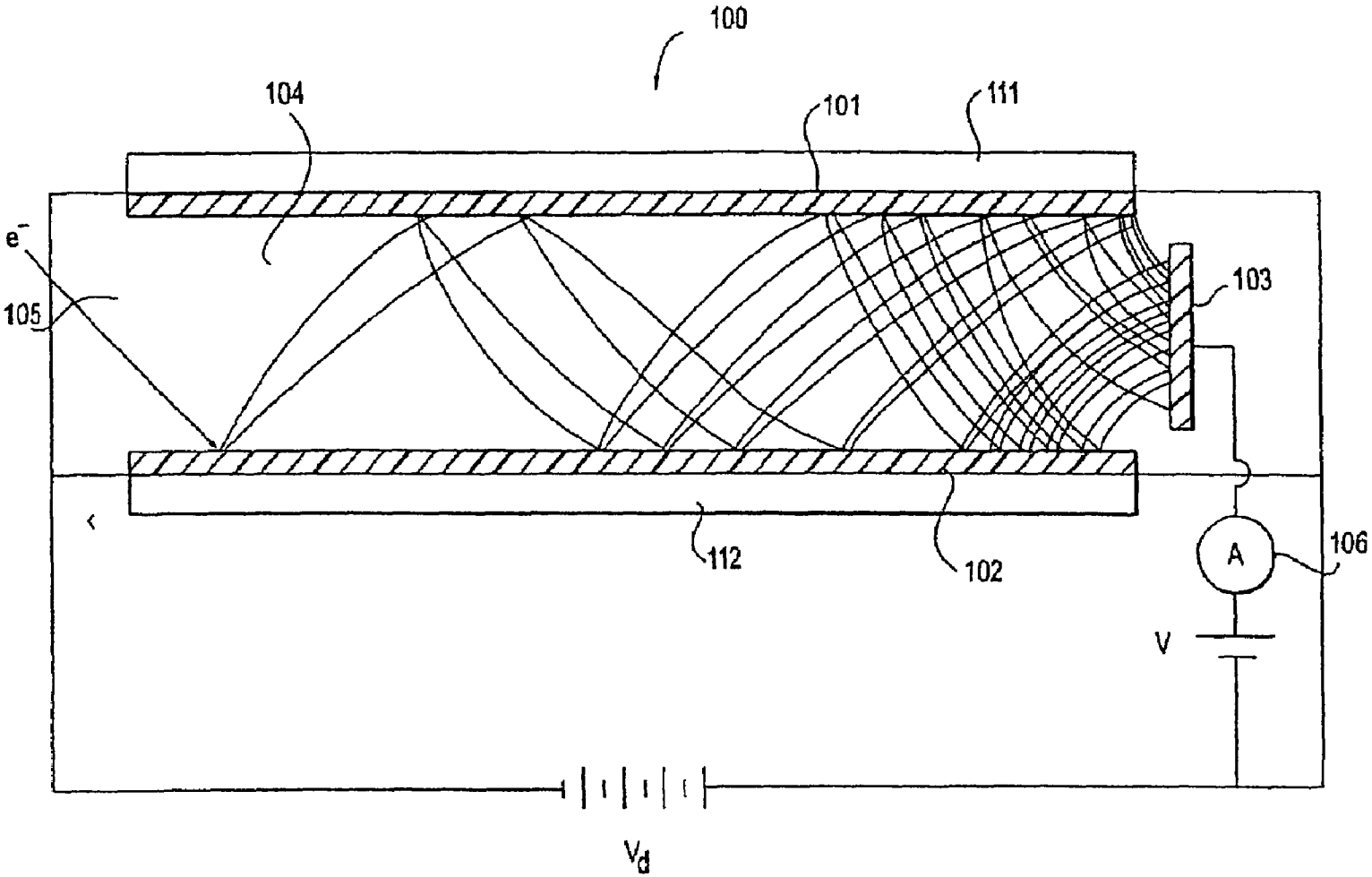
FIG. 1 PRIOR ART
FIG. 1 depicts a conventional parallel plate electron multiplier.

FIG. 1 shows a conventional parallel plate electron multiplier 100. Electron multiplier 100 includes secondary emitting surfaces 101 and 102, deposited on glass plates 111 and 112, respectively, and separated by a channel 104. A voltage Vd is applied along the length of electron multiplier 100 so that electrons entering at an open end 105 are accelerated along the length of electron multiplier 100 away from open end 105. When the electron collides with one of secondary emitting surfaces 101 and 102, multiple secondary electrons are emitted. The secondary electrons are then accelerated along electron multiplier 100 and themselves may collide with one of secondary emitting surfaces 101 and 102. On each collision of an electron with sufficient kinetic energy with one of emitting surfaces 101 or 102, further electrons are emitted. By repeated collisions of electrons with secondary emitting surfaces 101 and 102, an output pulse containing a very large number of electrons is emitted from electron multiplier 100.

The output pulse is received by collector 103 located on the side of electron multiplier 100 opposite from open end 105. Typically, collector 103 is held at an elevated voltage from the voltage of that end of electron multiplier 100. The output pulse is detected by detection circuitry 106 coupled to collector 103. The gain of electron multiplier 100 depends on the voltage Vd applied across electron multiplier 100, the secondary emission properties of secondary emitting surfaces 101 and 102, and the physical dimensions of electron multiplier 100.

As noted above, parallel plate electron multipliers having planar channel 104 are subject to ion feedback problems. Ion feedback causes a dispersion of the sensed signal as the ions travel backwards through channel 104 causing disbursed electron generation. This also provides excessive electron generation and a false reading at collector 103.

Figures 2A, 2B, 2C:
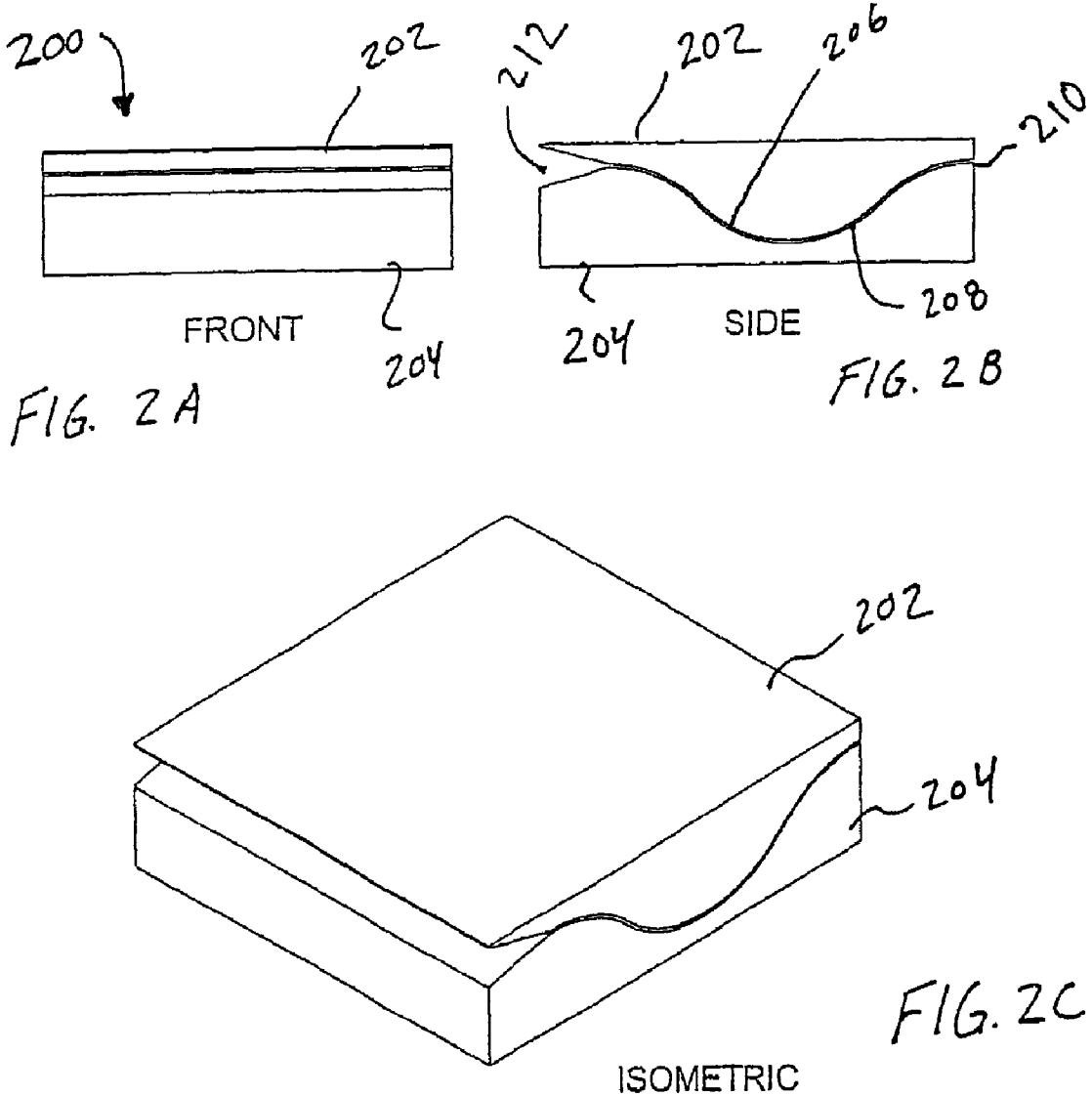
FIGS. 2A–2C are views of a parallel plate electron multiplier in an embodiment of the invention.

Embodiments of the invention reduce ion feedback by utilizing a non-planar or curved channel between parallel plates. FIGS. 2A–2C depict an electron multiplier 200 in an embodiment of the invention. The electron multiplier 200 includes two plates 202 and 204 having parallel interior surfaces 206 and 208 defining a channel 210. The input end 212 of channel 210 has an increased dimension to facilitate electrons entering channel 210. Channel 210 is non-planar and is referred to as a single wave design as it corresponds to one period of a waveform (e.g., a sinusoid).

Figures 3A, 3B, 3C:
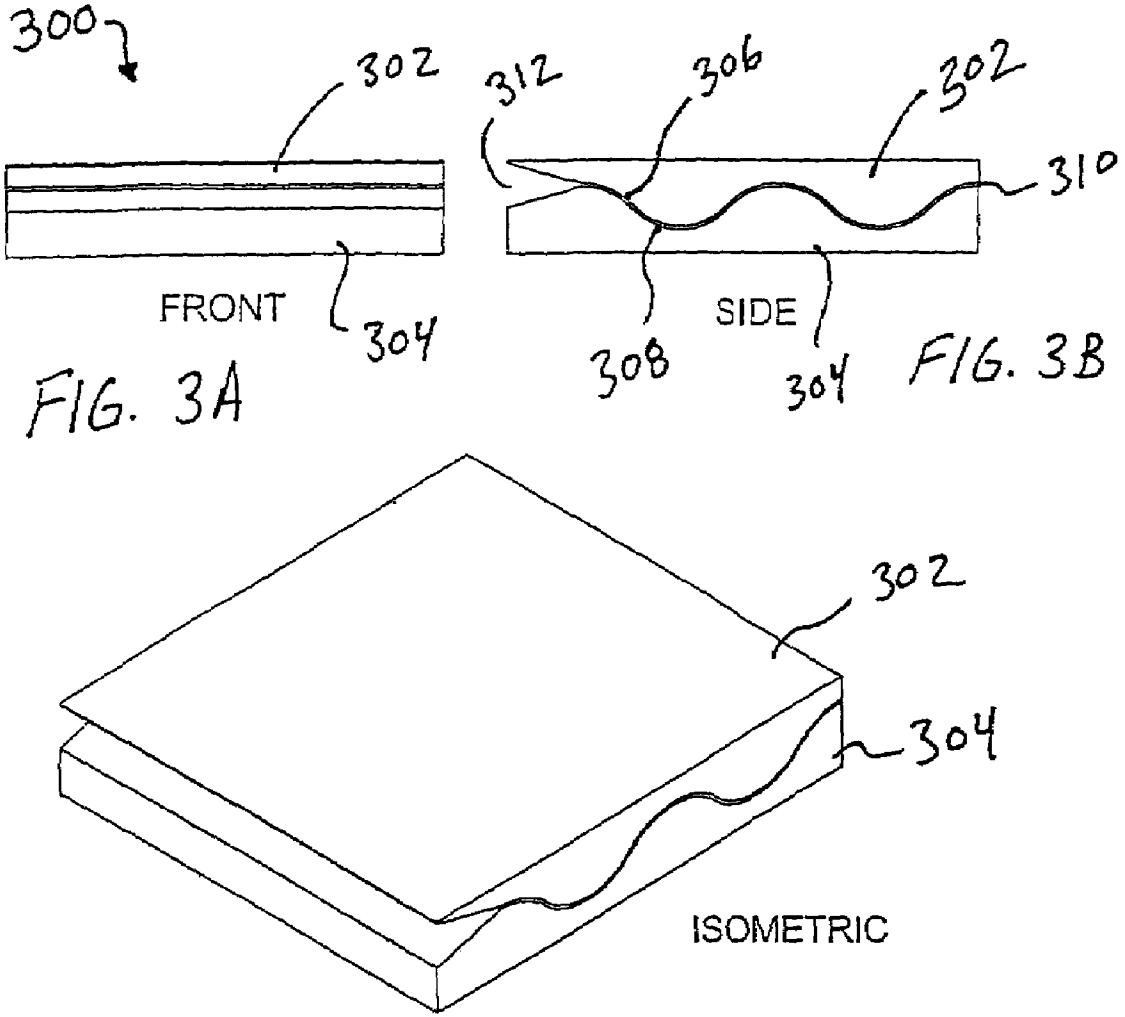
FIGS. 3A–3C are views of a parallel plate electron multiplier in an alternate embodiment of the invention.

FIGS. 3A–3C depict an electron multiplier 300 in an embodiment of the invention. The electron multiplier 300 includes two plates 302 and 304 having parallel interior surfaces 306 and 308 defining a channel 310. The input end 312 of channel 310 has an increased dimension to facilitate a beam entering channel 310. Channel 310 is non-planar and is referred to as a double wave design as it corresponds to two periods of a waveform (e.g., a sinusoid).

Figures 4A, 4B, 4C:
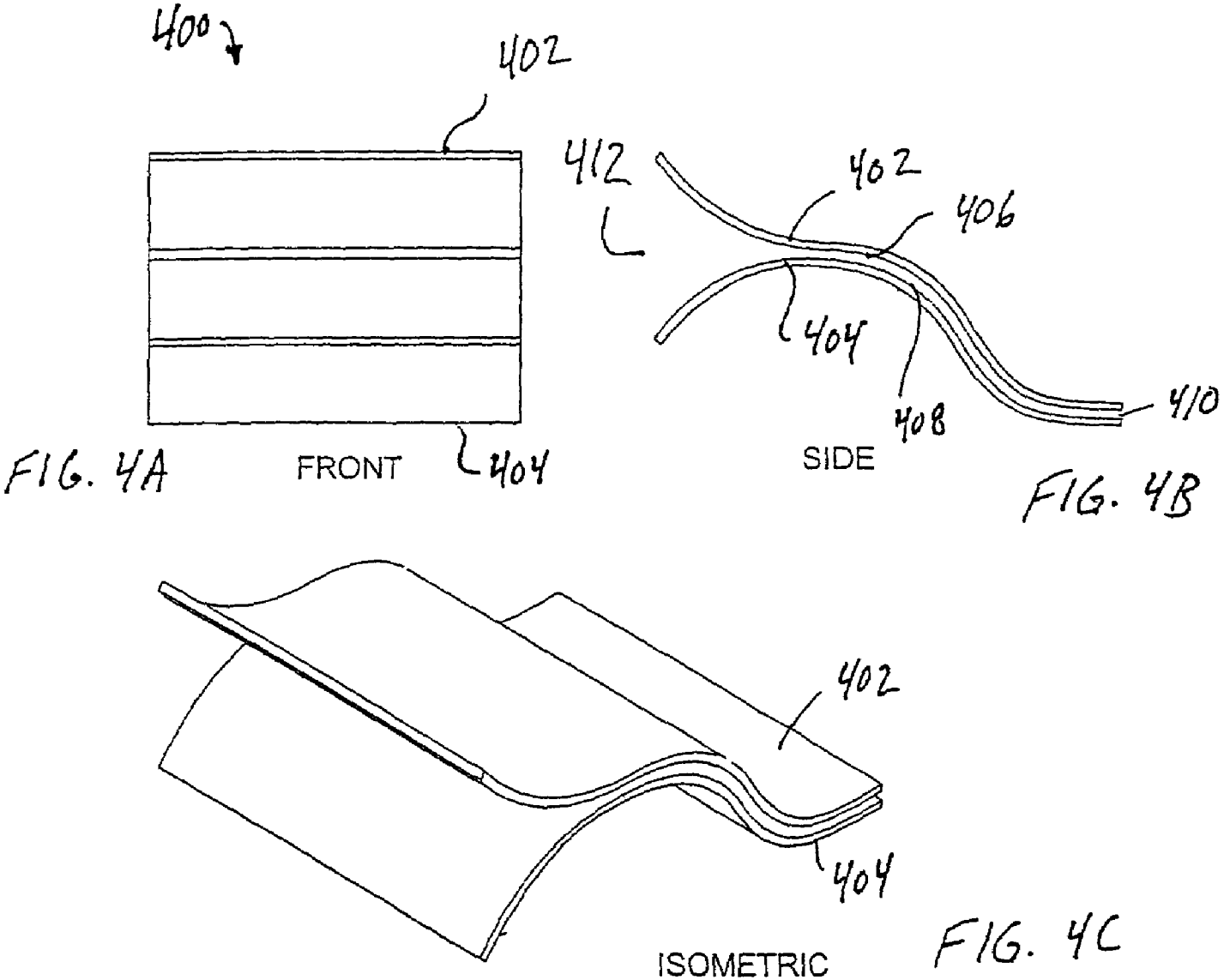
FIGS. 4A–4C are views of a parallel plate electron multiplier in an alternate embodiment of the invention.

FIGS. 4A–4C depict an electron multiplier 400 in an embodiment of the invention. The electron multiplier 400 includes two plates 402 and 404 having parallel interior surfaces 406 and 408 defining a channel 410. The input end 412 of channel 410 has an increased dimension to facilitate a beam entering channel 410. Channel 410 is non-planar and may be formed by thermally shaping glass plates.

Figures 5A, 5B, 5C:
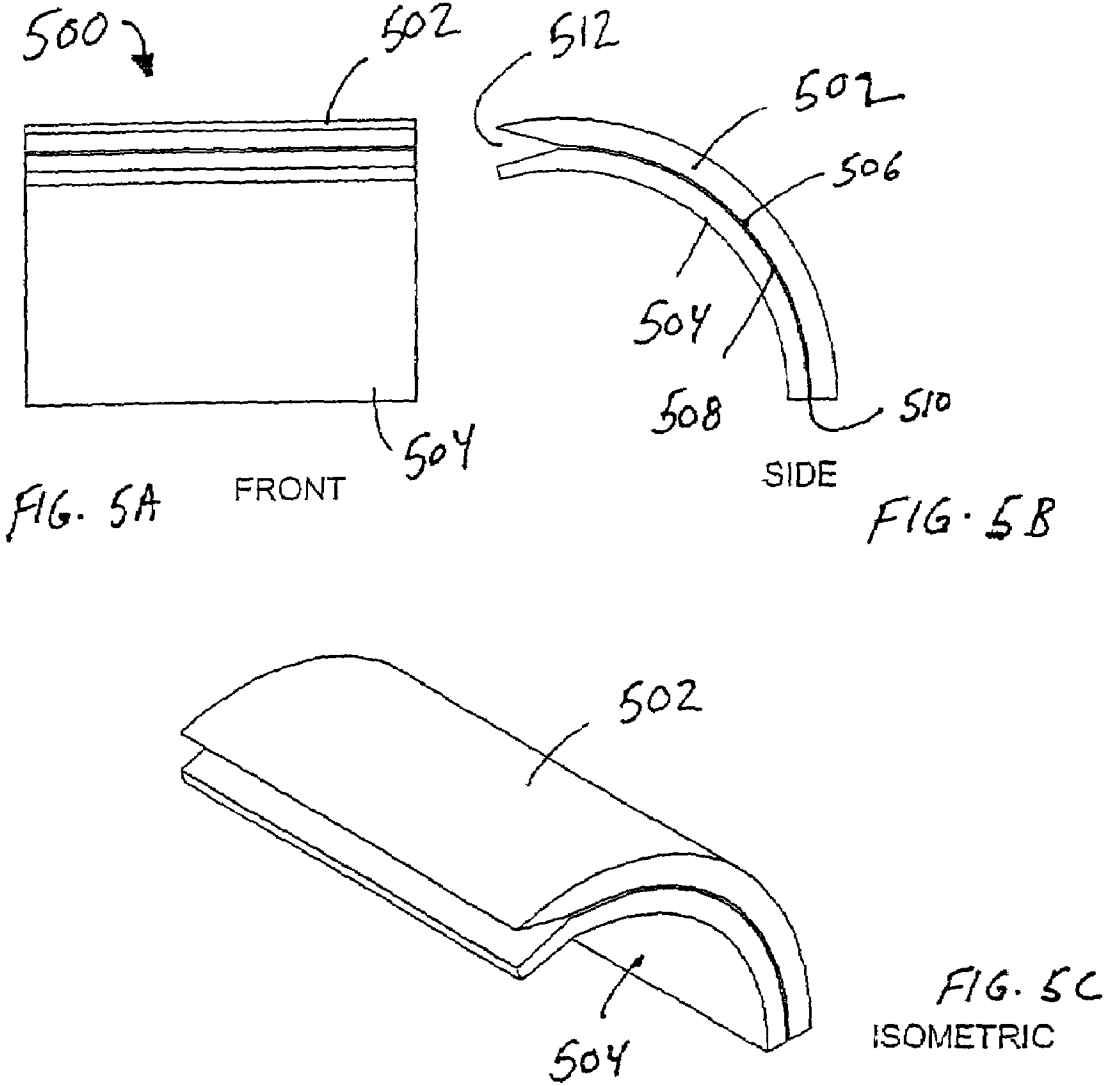
FIGS. 5A–5C are views of a parallel plate electron multiplier in an alternate embodiment of the invention.

FIGS. 5A–5C depict an electron multiplier 500 in an embodiment of the invention. The electron multiplier 500 includes two plates 502 and 504 having parallel interior surfaces 506 and 508 defining a channel 510. The input end 512 of channel 510 has an increased dimension to facilitate a beam entering channel 510. Channel 510 is a non-planar, constant radius channel and plates 502 and 504 correspond to arcs of concentric cylinders.

Figures 6A, 6B, 6C:
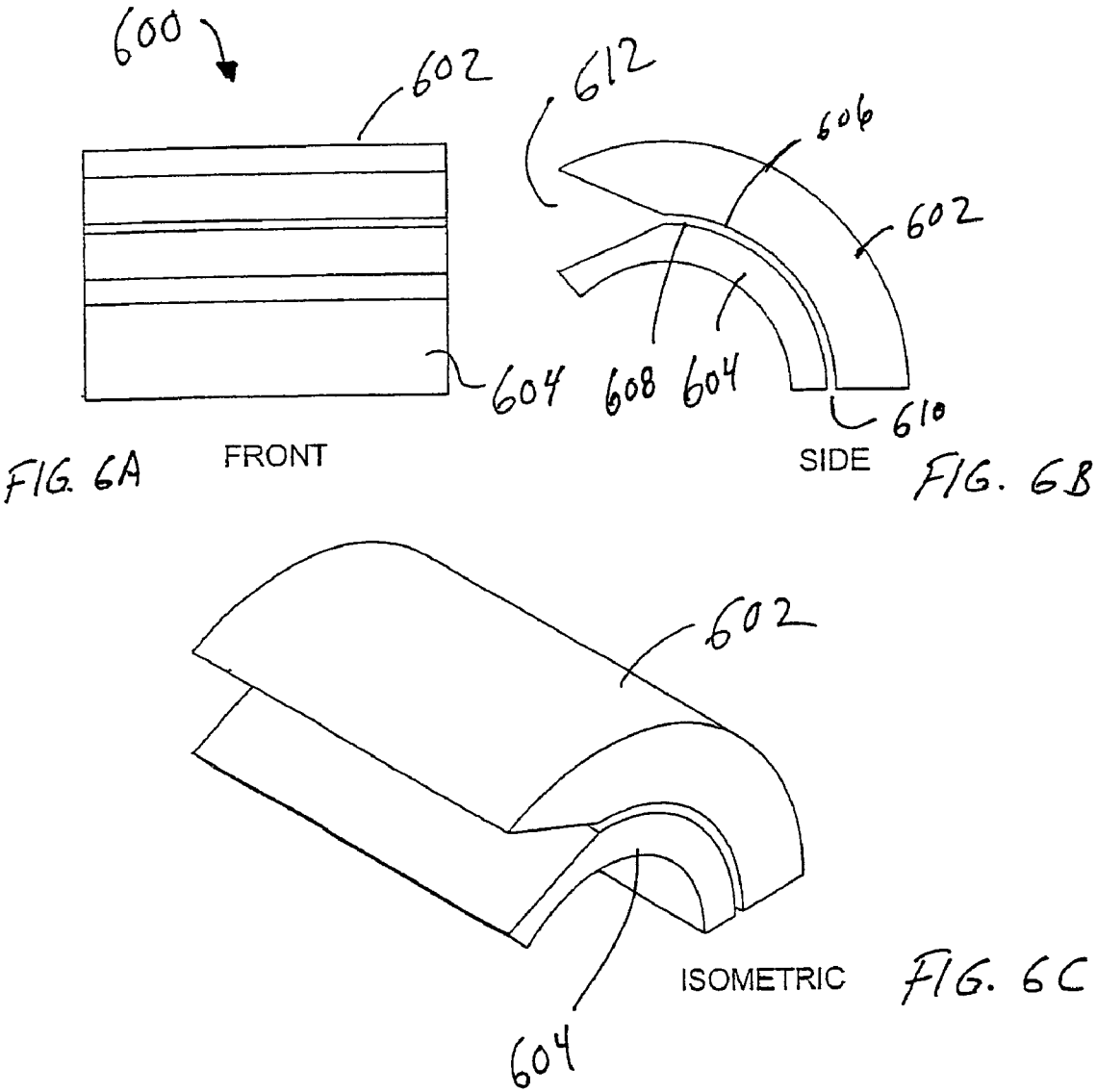
FIGS. 6A–6C are views of a parallel plate electron multiplier in an alternate embodiment of the invention.

FIGS. 6A–6C depict an electron multiplier 600 in an embodiment of the invention. The electron multiplier 600 includes two plates 602 and 604 having parallel interior surfaces 606 and 608 defining a channel 610. The input end 612 of channel 610 has an increased dimension to facilitate a beam entering channel 610. Channel 610 is non-planar and plates 602 and 604 correspond to arcs of concentric cylinders.

The embodiments of FIGS. 2–6 include a non-planar channel to reduce ion feedback. The non-planar channel limits the travel of ions in the channel thereby reducing the electron generation caused by ion feedback.

Figure 7:
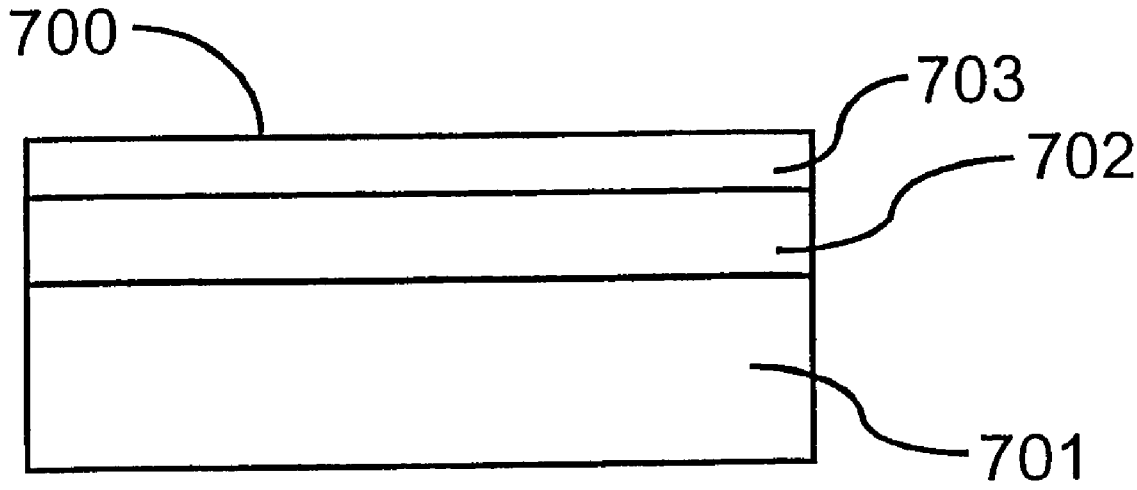
FIG. 7 depicts a cross sectional area of a multi-layer plate.

FIG. 7 depicts a cross sectional area of a multi-layer plate 700 utilized in embodiments of the invention. The first layer 701 is a support layer and allows the other layers to be positioned in a desirable orientation. The second layer 702 is a resistive layer that allows a voltage of a desired value to be placed across the multiplier to create an electric field that will accelerate generated electrons from the input or cathode end to the output or anode end. Layer 702 is resistive enough to support a biasing electric field without drawing excessive current and still be able to replenish electrons emitted from the emissive layer. The thickness and resistivity of the resistive layer should be uniform along the length of the channel to provide a constant electric field to accelerate the electrons toward the output end of the multiplier. The output end incorporates an anode that converts the electron pulse coming out of the channel into an electrical signal. The third layer 703 is an emissive layer. The multiplier makes use of the emissive layer to generate electron multiplication. The emissive surface will emit multiple electrons when struck by a charge or energetic neutral particle or photon of sufficient energy. The process is repeated down the length of the channel resulting the in multiplication process. The emissive layer has a secondary electron yield with an average greater than 1 to support the multiplication process.

The layers depicted in FIG. 7 can be formed of a single material such as a reduced lead oxide glass or a reduced bismuth oxide glass. Also, an appropriate emissive material such as those listed below could be deposited onto a reduced lead oxide or reduced bismuth oxide glass. Alternatively, the layers can be formed separately. For example, the emissive layer may be formed by a chemical vapor deposition (CVD) process. Materials that may be used for the emissive layer include but are not limited to diamond films, $Al_2O_3$, $Si_3N_4$, $SiO_2$, MgO, and BN. The semiconducting resistive layer may also be formed by a CVD process. The materials that may be used for this layer include but are not limited to Si, C, Ge, and $Si_3N_4$ films that are doped to an appropriate resistivity. Substrate materials for the support layer include but are not limited to $Al_2O_3$, AlN, Si, $SiO_2$ glass, $Si_3N_4$, and SiC. Another example is a CVD silicon film doped to an appropriate resistivity deposited on a supporting substrate. Oxidation of the silicon forms the emissive layer.

Embodiments of the invention overcome the difficulties with accommodating non-circular beam cross sections encountered with channel electron multipliers by employing parallel plate type of construction. The plates can be configured to form a detection region or channel of any desired geometry. This detection region can be used for detection of incoming charged or energetic neutral particle/photon beams with a variety of cross sectional areas. For example, the channel can be used to accommodate beams having elliptical cross sections, rectangular cross sections, etc. Embodiments of the invention overcome the difficulties with ion feedback by utilizing a non-planar channel to limit the distance feedback ions can travel is formed. The channel can be formed so that the shape along the length of the multiplier is a curved path such as a wave shape or a section of a circle.

Embodiments of the invention may be used to amplify electron, ion, photon, or energetic neutral signals. Embodiments of the invention may also be used as detectors in mass spectrometers for sample identification. Embodiments of the invention may also be used in surface analytical techniques such as Secondary Ion Mass Spectrometry (SIMS), Auger electron spectroscopy (AES), X-ray photoelectron spectroscopy, ultraviolet photoelectron spectroscopy, and electron energy loss spectroscopy. Embodiments of the invention may also be used for electron multiplication in a photon multiplier application and for detection of secondary and back-scattered electrons in electron microscopes, focused ion-beam tools and e-beam lithography.

While the invention has been described with reference to exemplary embodiments, it will be understood by those skilled in the art that various changes may be made and equivalents may be substituted for elements thereof without departing from the essential scope thereof. Therefore, it is intended that the invention not be limited to the particular embodiments disclosed for carrying out the invention, but that the invention will include all embodiments falling within the scope of the appended claims.

What is claimed is:

1. A electron multiplier comprising:

a first plate having a first interior surface, said first interior surface being electron emissive;

a second plate having a second interior surface, said second interior surface being electron emissive, the second plate being separate from the first plate;

the first plate and the second plate are spaced apart to define a channel, the channel having an input end receiving electrons;

a voltage source connected across said first plate and said second plate;

a collector at an output end of the channel, the collector generating a signal responsive to electron multiplication by said first plate and said second plate;

wherein said first interior surface and said second interior surface are parallel and are non-planar, the channel providing a non-linear path from the input end to the output end.

2. The electron multiplier of claim 1 wherein:

said first interior surface and said second interior surface correspond to one period of a waveform.

3. The electron multiplier of claim 1 wherein:

said first interior surface and said second interior surface correspond to two periods of a waveform.

4. The electron multiplier of claim 1 wherein:

said first plate and said second plate correspond to sections of concentric cylinders.

5. The electron multiplier of claim 1 wherein:

said first plate and said second plate are made from reduced lead oxide glass or reduced bismuth oxide glass.

6. The electron multiplier of claim 1 wherein:

said first plate and said second plate are formed in multiple layers.

7. The electron multiplier of claim 6 wherein:

one of said layers is a support layer.

8. The electron multiplier of claim 7 wherein:

said support layer is made from $Al_2O_3$, AlN, Si, $SiO_2$ glass, $Si_3N_4$, or SiC.

9. The electron multiplier of claim 6 wherein:

one of said layers is a resistive layer.

10. The electron multiplier of claim 9 wherein:

said resistive layer is made from Si, C, Ge, or $Si_3N_4$.

11. The electron multiplier of claim 10 wherein:

said resistive layer is chemical vapor deposited.

12. The electron multiplier of claim 6 wherein:

one of said layers is an electron emissive layer.

13. The electron multiplier of claim 12 wherein:
said electron emissive layer is made from diamond films, $Al_2O_3$, $Si_3N_4$, $SiO_2$, MgO, or BN.

14. The electron multiplier of claim 12 wherein:
said electron emissive layer is chemical vapor deposited.

15. The electron multiplier of claim 1 wherein:
the input end of the channel has an increased dimension with respect to the remainder of the channel.

* * * * *